US006568775B2

(12) United States Patent
Zaremba

(10) Patent No.: US 6,568,775 B2
(45) Date of Patent: May 27, 2003

(54) DUAL MODE COMMUNICATION DEVICE FOR A FLUID EJECTION DEVICE

(75) Inventor: Andrew Joseph Zaremba, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/003,987

(22) Filed: Oct. 31, 2001

(65) Prior Publication Data

US 2003/0081021 A1 May 1, 2003

(51) Int. Cl.[7] ..... B41S 2/01
(52) U.S. Cl. ..... 347/5; 347/19; 347/50
(58) Field of Search ..... 347/5, 19, 50, 347/85–87

(56) References Cited

U.S. PATENT DOCUMENTS 5,666,530 A * 9/1997 Clark et al. ..... 395/617
6,039,430 A * 3/2000 Helterline et al. ..... 347/19
6,210,522 B1 * 4/2001 Singh et al. ..... 156/313

* cited by examiner

*Primary Examiner*—Craig Hallacher

(57) ABSTRACT

The present invention includes as one embodiment a fluid ejection device coupled to a controller that sends and receives data signals to and from the fluid ejection device, the printhead comprising a communication device that facilitates data signal transfer between the printhead and the controller through both physical electrical contact and radio frequency signals.

20 Claims, 3 Drawing Sheets

DUAL MODE COMMUNICATION DEVICE FOR A FLUID EJECTION DEVICE

FIELD OF THE INVENTION

One embodiment of the present invention generally relates to fluid ejection devices and in particular to a system and method for implementing a communication device that operates with two modes of communication, namely, an electrical contact communication mode and a non-contact communication mode, such as a radio frequency communication mode.

BACKGROUND OF THE INVENTION

Inkjet printers print dots by ejecting very small drops of ink onto a print medium. For any line of print, a carriage may make more than one traverse and utilize a varying number of nozzles. An ink supply, such as an ink reservoir, supplies ink to the nozzles of the printhead. The printhead communicates with the printer via a local device or a remote device. The local communication device can be located on the printhead itself, while the remote device can be located on a remote ink supply, the printer or somewhere else other than the printhead.

These devices include memory devices or proactive processors. For a memory device, the communication includes receiving power and data from the printer, and sending it to the printhead. In the case of a processor, the communication includes everything the memory device provides, but in addition, producing its own commands that control the ejection of ink drops of ink of the printhead at appropriate times pursuant to the processor or controller.

The typical method of facilitating communication between the printhead, the printer and the communication device includes using physical contact points. However, these physical contact points usually need close mechanical manufacturing registration to ensure reliability. For example, the process may include using a gold layer to provide high conductivity for the physical connection while providing corrosion resistance.

SUMMARY OF THE INVENTION

The present invention includes an embodiment for implementing a communication device for a fluid ejection device that operates with two modes of communication, namely, an electrical contact communication mode and a non-contact communication mode, such as a radio frequency (RF) communication mode.

The embodiments of the present invention as well as a more complete understanding thereof will be made apparent from a study of the following detailed description of the invention in connection with the accompanying drawings and appended claims.

BRIEF DESCRIPTION OF THE DRAWINGS

The embodiments of the present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the preferred embodiments, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview of Components

One embodiment of the present invention includes a system and method for an inkjet printhead assembly that uses one or more dual mode communication devices. The modes of communication include a contact mode, such as with electrical contact points, and a non-contact mode, such as with radio frequency (RF) signals. The communication devices of one embodiment of the present invention can be memory devices or proactive processors with memory capabilities and receive and/or send signals to and from a controller and can be embodied as elements 118, 122 or 306 shown in FIGS. 1 and 3 and described below.

Figure 1:
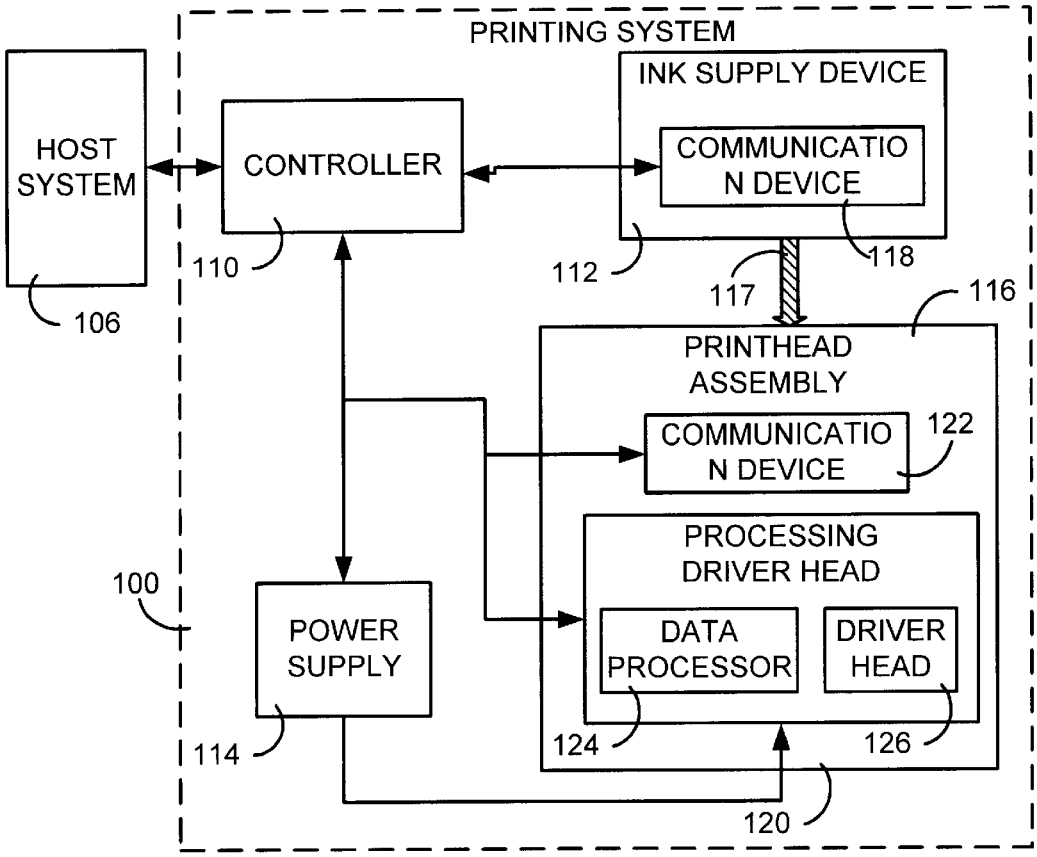
FIG. 1 is one embodiment showing a block diagram of an overall printing system incorporating the present invention.

FIG. 1 shows a block diagram of an overall printing system of this embodiment. The printing system 100 can be used for printing material, such as ink on a print media, which can be paper. The printing system 100 is electrically coupled to a host system 106, which can be a computer or microprocessor for producing print data. The printing system 100 includes a controller 110 coupled to an ink supply device 112, a power supply 114, and a printhead assembly 116.

The ink supply device 112 can be incorporated within a reservoir of the printhead assembly 116 or as an external device fluidically coupled to the printhead assembly 116 with a fluidic supply line. The ink supply device supplies ink 117 to the printhead assembly 116. The ink supply device includes an ink supply communication device 118 (which can be a memory device or a programmable data processor) with two modes of communication.

The printhead assembly also includes a communication device 122 and a processing driver head 120 with a data processor 122 and a driver head 124, such as an array of inkjet nozzles or drop generators. During operation of the printing system 100, the power supply 114 provides a controlled voltage to the controller 110 and the processing driver head 120. Also, the controller 110 receives the print data from the host system and processes the data into printer control information and image data. The processed data, image data and other static and dynamically generated data, are exchanged with the ink supply device 112 and the printhead assembly 116 for efficiently controlling the printing system.

The ink supply communication device 118 can store various ink supply specific data, including ink identification data, ink characterization data, ink usage data etc. The ink supply data can be written and stored in the ink supply communication device 118 at the time the ink supply device 112 is manufactured or during operation of the printing system 100. Similarly, the printhead communication device 122 can store various printhead specific data, including printhead identification data, warranty data printhead characterization data, printhead usage data, etc. This data can be written and stored in memory of the printhead communication device 122 at the time the printhead assembly 116 is manufactured or during operation of the printing system 100.

The data processor 124 also communicates with the controller 110 in a bi-directional manner. The bi-directional communication enables the data processor 124 to dynamically formulate and perform its own firing and timing operations based on sensed and given operating information for regulating the temperature of, and the energy delivered to the processing driver head 120. These formulated decisions are preferably based on, among other things, sensed printhead temperatures, sensed amount of power supplied, real time tests, and pre-programmed known optimal operating ranges, such as temperature and energy ranges, and scan axis directionality errors.

Either one of the communication devices 118, 122 can be present or both during operation. The communication devices 118, 122 use a contact mode, such as electrical contact points, and a non-contact mode, such as radio frequency (RF) signals to communicate. The communication devices 118, 122 receive and/or send signals to and from the controller 110. RF signals can be used to couple energy into the communication devices 118, 122 and to provide a communications path to and from the controller 110. Also, in an alternative embodiment, the distributive processor includes a communication mechanism similar to the communication devices 118, 122 to allow contact and non-contact communication with the controller 110.

II. Exemplary Printing System

Figure 2:
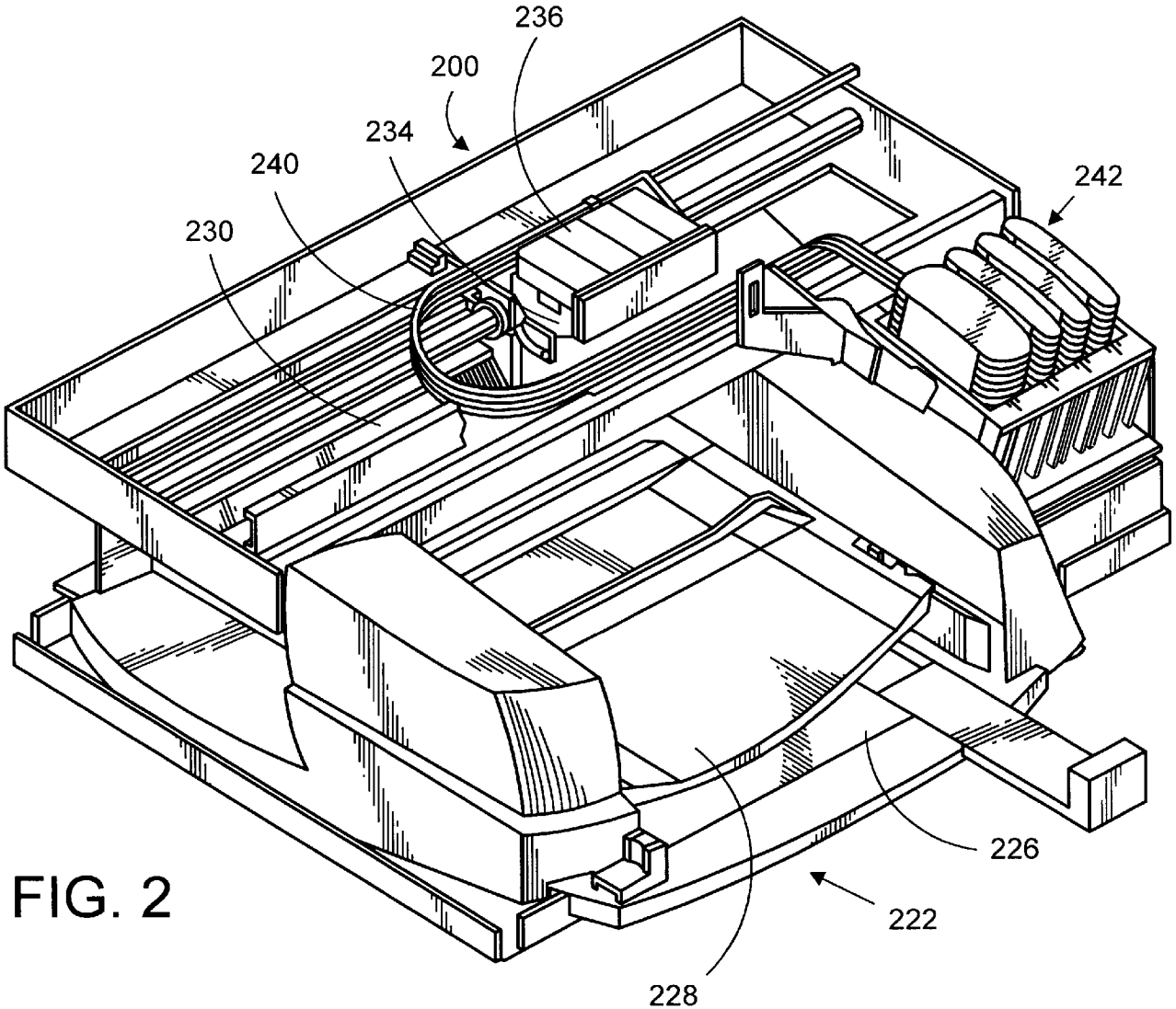
FIG. 2 is one embodiment of an exemplary printer that incorporates the invention and is shown for illustrative purposes only.

FIG. 2 is one embodiment of an exemplary printer that incorporates the invention and is shown for illustrative purposes only. Generally, printer 200 can incorporate the printing system 100 of FIG. 1 and further include a tray 222 for holding print media. When printing operation is initiated, print media, such as paper, is fed into printer 200 from tray 222 preferably using sheet feeder 226. The sheet then brought around in a U direction, then travels in an opposite direction toward output tray 228.

Other paper paths, such as straight paper path, can also be used. The sheet is stopped in a print zone 230, and a scanning carriage 234, supporting one or more printhead assemblies 236, is then scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be remove-ably mounted or permanently mounted to the scanning carriage 234. Also, the printhead assemblies 236 can have self-contained ink reservoirs as the ink supply 112 of FIG. 1. The self-contained ink reservoirs can be refilled with ink for re-using the print assemblies 236. Alternatively, each print cartridge 236 can be fluidically coupled, via a flexible conduit 240, to one of a plurality of fixed or removable ink containers 242 acting as the ink supply 112 of FIG. 1.

Figure 3:
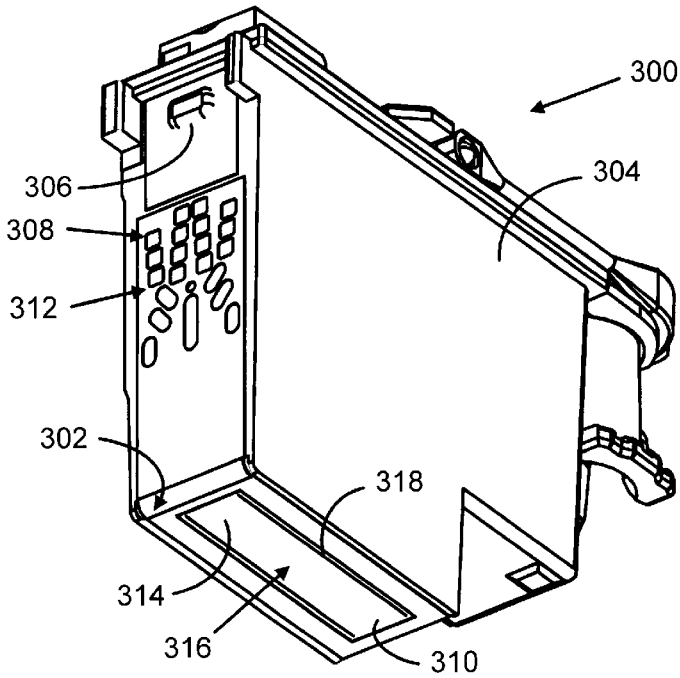
FIG. 3 is one embodiment that shows for illustrative purposes only a perspective view of an exemplary print cartridge incorporating the present invention.

FIG. 3 is one embodiment that shows for illustrative purposes only a perspective view of an exemplary print cartridge (an example of the printhead assembly 116 of FIG. 1) incorporating the present invention. A detailed description of one embodiment of the present invention follows with reference to a typical printhead assembly used with a typical printer, such as printer 200 of FIG. 2. However, the embodiments of the present invention can be incorporated in any printhead and printer configuration Referring to FIGS. 1 and 2 along with FIG. 3, the printhead assembly 116 is comprised of a thermal inkjet head assembly 302, a printhead body 304 and printhead communication device 122. The thermal head assembly 302 can be a flexible material commonly referred to as a Tape Automated Bonding (TAB) assembly and can contain processing driver head 120 and interconnected pads 312. The interconnected contact pads 308 are suitably secured to the printhead 116, for example, by an adhesive material. The contact pads 308 align with and electrically contact electrodes (not shown) on carriage 234 of FIG. 2.

The processing driver head 120 includes the distributive processor 124 preferably integrated with a nozzle member or driver head 126. The distributive processor 124 preferably includes digital circuitry and communicates via electrical signals with the controller 110, nozzle member (driver head) 126 and various analog devices, such as temperature sensors, which can be located on the nozzle member 126.

The distributive processor 124 processes the signals for precisely controlling firing, timing, thermal and energy aspects of the printhead assembly 116 and nozzle member 126. The nozzle member 126 preferably contains plural orifices or nozzles 318, which can be created by, for example, laser ablation, for creating ink drop generation. In an alternative embodiment, the distributive processor 124 includes a communication mechanism similar to the communication devices 118, 122 and 306 to allow contact and non-contact communication with the controller 110.

III. Detailed Operation

Figure 4:
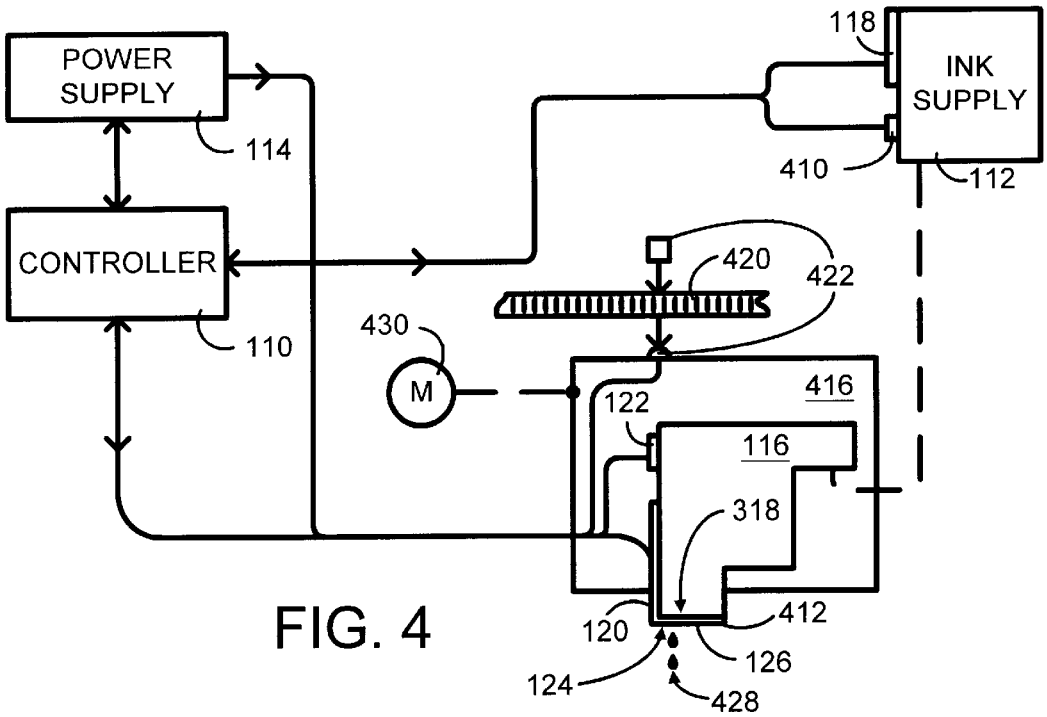
FIG. 4 is one embodiment illustrated as a block diagram of the interaction between the communication device and the controller.

FIG. 4 is one embodiment illustrated as a block diagram of the interaction between the communication device and the controller. Referring to FIGS. 1 and 3 along with FIG. 4, the controller 110 is coupled to the ink supply communication device 118 and an ink level sensor 410 of the ink supply 112, a power supply 114, the printhead communication device 122, the processing driver head 120 and sensors 412 of a printhead assembly 116, a printhead carriage 416 and an encoder strip 420 via detection system 422.

The ink supply 112 is shown in FIG. 4 as a separate unit, but can be physically integrated within the printhead 116 as an ink reservoir within body 304 of FIG. 3. The ink supply 112 is fluidically coupled to the printhead assembly 116 for selectively providing ink to the printhead assembly 116. The driver head 126 can be an array of inkjet nozzles or drop generators for ejecting ink drops 428. The printhead 116 can also include sensors 412, such as temperature sensors for controlling the energy delivered to, and the temperature of, the printhead assembly 116.

In operation, the detection system 422 detects a position of printhead assembly 116 and printhead carriage 416 relative to the encoder strip 420, formulates position signals and sends the position signals to the controller for indicating an exact relative position of the printhead assembly 116. A transport motor 430 is coupled to the controller 110 and the printhead assembly 116 for positioning and scanning the printhead assembly 116.

The power supply 114 provides a controlled voltage or voltages to the controller 110 and the processing driver head 120. The data or distributive processor 124 can communicate directly with the controller 110 with its own contacted or non-contacted communication device similar to communication devices 118 and 122. The communication enables the data processor 124 to dynamically formulate and perform its own firing and timing operations based on sensed and given operating information for regulating the temperature of, and the energy delivered to the printhead assembly 116.

These formulated decisions are based on printhead temperatures sensed by the sensors 412, sensed amount of power supplied, real time tests, and preprogrammed known optimal operating ranges, such as temperature and energy ranges, scan axis directionality errors, etc. Moreover, direct communications allows the addition of nozzles without the inherent need to increase leads and interconnections.

Similar to as described above in FIG. 1, all of the communication devices can be present or just one during operation. The communication devices 118 and 122 use a contact mode, such as electrical contact points, and a non-contact mode, such as radio frequency (RF) signals to communicate with the controller 110. The communication devices 118, 122 receive and/or send signals to and from the controller 110.

In the contact mode, a continuous physical electrical connection is used to provide communication between the communication devices 118, 122, the printhead, and the controller 110. In the non-contact mode, a suitable RF coupling configuration is used to preferably provide direct communication between the communication devices 118, 122 and the controller 110. For example, the communication devices 118, 122 can include a suitable RF communication energy coupler (not shown) that couples energy to the communication devices and to provides communications with a receiver remotely located, such as on the printer, for wireless communication.

Either communication between the communication devices 118 and 122 and the controller 110 allows proper printing. Namely, at the commands of the controller through the communication devices 118, 122, each ink ejection element of the driver head 126 acts as an ohmic heater when selectively energized by one or more pulses applied sequentially or simultaneously. The ink ejection elements may be heater resistors or piezoelectric elements. The nozzles 318 may be of any size, number, and pattern, and the various figures are designed to simply and clearly show the features of the embodiments of the invention. The relative dimensions of the various features have been greatly adjusted for the sake of clarity.

IV. Working Example

Figure 5:
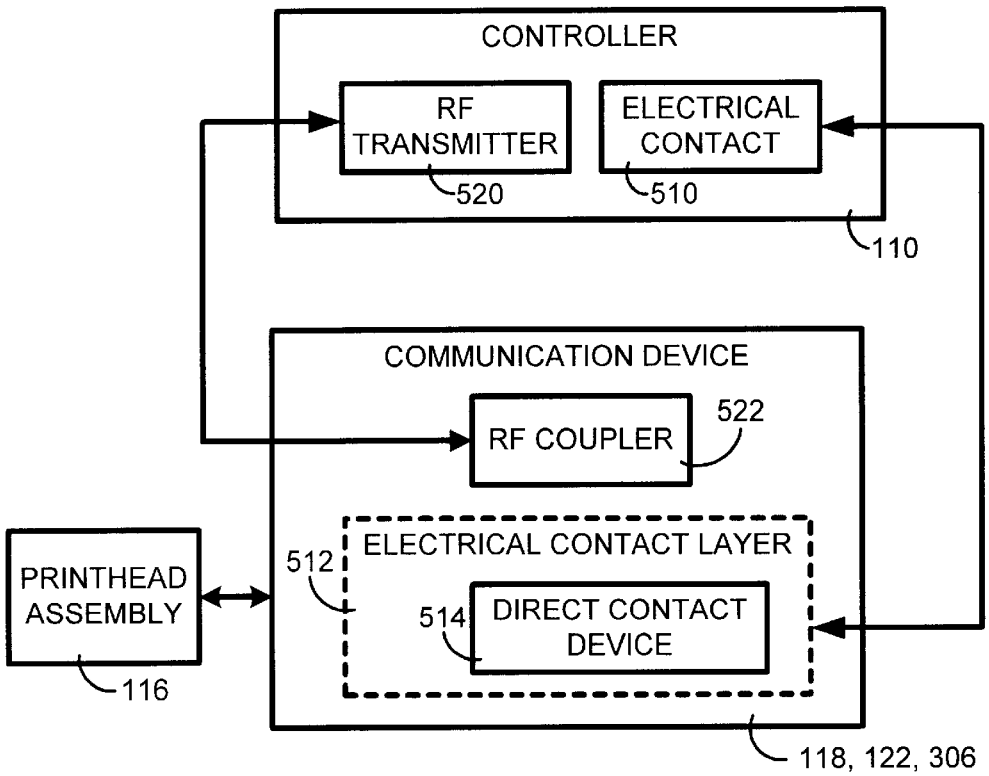
FIG. 5 is a working example of one embodiment illustrated as a block diagram of the overall functional interaction between the components of the printing system.

FIG. 5 is a working example of one embodiment illustrated as a block diagram of the overall functional interaction between the components of the printing system. In the contact embodiment of the present invention, the controller 110 communicates with the printhead assembly 116 via the communication device 118, 122, 206 with an electrical signal 510. This signal is transmitted to the communication device 118, 122, 306 through an electrical contact layer 512, then to a direct contact device 514. This allows the controller to receive and send data and to control printing operations. The direct contact device 514 enables power and communication to be exchanged with the printhead 116 via direct contact with the printhead assembly 116 and through the electrical contact layer 512, which resists corrosion, and is preferably a gold-coated layer.

In the non-contact embodiment, which can operate simultaneously with or separately from the contact model the communication device 118, 122, 306 of the printhead assembly 116 is not in direct electrical contact with the controller 110. Instead, the controller uses an RF transmitter 520 that is wirelessly coupled to an RF coupler 522 of the communication device 118, 122, 306. Since the non-contact embodiment does not invoke contact, it has the advantage of completely resisting corrosion without using physical layers or coatings, to thereby increase the reliability and longevity of the printhead 116.

Since the dual mode communication devices 118 and 122 allow the printhead to operate in either a contact mode (electrical contact points) or a non-contact mode (RF signals), the usefulness of the printhead is expanded across present as well as future platforms with differing connection technologies. This allows the printhead to be adapted for certain regions by enabling post-manufacturing data manipulation during product design and manufacturing.

What is claimed is:

1. A fluid ejection device coupled to a controller that sends and receives data signals to and from the fluid ejection device, the printhead comprising:

a communication device that facilitates data signal transfer between the printhead and the controller through both physical electrical contact and radio frequency signals.

2. The printhead of claim 1, wherein the communication device includes an RF coupler and physical electrical contacts.

3. The printhead of claim 2, wherein the physical electrical contact points include a gold corrosion protective layer.

4. The printhead of claim 2, wherein the communication device further includes a memory device for storing data pertinent to printing.

5. The printhead of claim 1, wherein the communication device includes a distributive programmable data processor.

6. The printhead of claim 1, further comprising a fluid communication device that is coupled to the controller through both physical electrical contact and radio frequency signals to control a fluid supply.

7. The printhead of claim 1, wherein the physical electrical contact and radio frequency signals communicate with the controller simultaneously.

8. A memory device of a printhead coupled to a controller for sending and receiving data signals to and from the printhead, the memory device comprising:

a communication device with a physical electrical contact area and a radio frequency coupler for sending and receiving data signals between the printhead and the controller; and a storage area for storing data pertinent to printing.

9. The memory device of claim 8, wherein the physical electrical contact area includes a gold corrosion protective layer.

10. The memory device of claim 8, wherein the communication device includes a distributive programmable data processor.

11. The memory device of claim 8, further comprising a communication interface between the memory device and an ink communication device.

12. The memory device of claim 11, wherein the ink communication device is coupled to the controller through both physical electrical contact and radio frequency signals for controlling an ink supply.

13. The memory device of claim 12, wherein the ink communication device includes a memory device for storing data regarding the ink.

14. The memory device of claim 8, wherein the physical electrical contact and radio frequency signals communicate with the controller simultaneously.

15. A method for sending and receiving data signals between a controller and a printhead, the method comprising:

transferring data signals between the printhead and the controller through physical electrical contacts; and transferring data signals between the printhead and the controller through radio frequency signals.

16. The method of claim 15, further comprising coupling RF signals and physical electrical contacts to facilitate radio frequency and physical electrical communication, respectively.

17. The method of claim 15, further comprising providing a gold corrosion protective layer to the physical electrical contacts.

18. The method of claim 15, further comprising providing a memory device for storing data pertinent to printing.

19. The method of claim 15, further comprising providing a distributive programmable data processor.

20. The method of claim 15, wherein physical electrical contact and radio frequency signals of the printhead communicate with the controller simultaneously.

* * * * *